US009073732B2

(12) United States Patent
LaValley et al.

(10) Patent No.: US 9,073,732 B2
(45) Date of Patent: Jul. 7, 2015

(54) GRAB ARM HOUSING FOR GRAPPLE ATTACHMENT

(71) Applicant: LAVALLEY INDUSTRIES, LLC, Bemidji, MN (US)

(72) Inventors: Jason LaValley, Bemidji, MN (US); Daniel L. Larson, Bagley, MN (US); Jesse J. Kilde, Blackduck, MN (US); Tim Berg, Mendota Heights, MN (US); David Cress, Eagan, MN (US); Stuart Johnson, Shoreview, MN (US); Matthew J. Michel, St. Paul, MN (US); Rodney Wurgler, York, ND (US)

(73) Assignee: LAVALLEY INDUSTRIES, LLC, Bemidji, MN (US)

( * ) Notice: Subject to any disclaimer, the term of this patent is extended or adjusted under 35 U.S.C. 154(b) by 10 days.

(21) Appl. No.: 13/951,938

(22) Filed: Jul. 26, 2013

(65) Prior Publication Data

US 2014/0028038 A1 Jan. 30, 2014

Related U.S. Application Data

(60) Provisional application No. 61/676,509, filed on Jul. 27, 2012.

(51) Int. Cl.

| | |
|---|---|
| ***B66C 1/12*** | (2006.01) |
| ***E21B 19/20*** | (2006.01) |
| ***B66C 1/44*** | (2006.01) |
| ***B66C 1/42*** | (2006.01) |

(52) U.S. Cl.
CPC .. *B66C 1/44* (2013.01); *B66C 1/427* (2013.01)

(58) Field of Classification Search
USPC ..... 294/81.61, 198, 86.4, 86.41, 67.5, 106; 414/744.8, 815, 729, 732, 739; 228/49.3; 144/4.1, 34.1, 34.5; 901/38, 901/39
See application file for complete search history.

(56) References Cited

U.S. PATENT DOCUMENTS

| | | | |
|---|---|---|---|
| 3,231,303 | A | 1/1966 | LeTourneau |
| 3,311,350 | A | 3/1967 | Irwin |

(Continued)

FOREIGN PATENT DOCUMENTS

| | | |
|---|---|---|
| CA | 2641321 | 4/2009 |
| DE | 295 02 091 U1 | 4/1995 |

(Continued)

OTHER PUBLICATIONS

Indexator Rototilt® print outs from www.indexatornorthamerica.com/index.php, printed on Sep. 8, 2011; 1 page.

(Continued)

*Primary Examiner* — Paul T Chin
(74) *Attorney, Agent, or Firm* — Hamre, Schumann, Mueller & Larson, P.C.

(57) ABSTRACT

A two-piece grab arm housing for a grapple mechanism useable on a grapple attachment is described. The grab arm housing includes a lower arm housing with grab arms mounted to the lower arm housing, and an upper arm housing mounted to the lower arm housing. The upper arm housing and the lower arm housing are movable relative to one another in an x-direction and are moveable together in a y-direction perpendicular to the x-direction. In addition, the upper arm housing includes an opening through which a main beam of the grapple attachment can extend.

12 Claims, 7 Drawing Sheets

(56) References Cited

U.S. PATENT DOCUMENTS

| | | | | |
|---|---|---|---|---|
| 3,333,717 | A | 8/1967 | Scaperotto | |
| 3,561,615 | A | 2/1971 | Forsberg et al. | |
| 3,713,554 | A | 1/1973 | Thompson et al. | |
| 3,719,296 | A | 3/1973 | Larson, Jr. | |
| 3,727,653 | A | 4/1973 | Tucek | |
| 3,817,567 | A | 6/1974 | Lull | |
| 3,911,981 | A | 10/1975 | Tucek | |
| 3,927,778 | A | 12/1975 | Zrostlik | |
| 4,212,577 | A | 7/1980 | Swanson | |
| 4,486,136 | A | 12/1984 | Howard | |
| 4,697,509 | A | 10/1987 | LaBounty | |
| 4,810,019 | A | 3/1989 | Brucher | |
| 4,858,979 | A | 8/1989 | Parma | |
| 4,951,990 | A | 8/1990 | Hollan et al. | |
| D323,169 | S | 1/1992 | Saito | |
| 5,209,536 | A | 5/1993 | Rogers, Sr. et al. | |
| 5,219,265 | A | 6/1993 | Recker | |
| 5,330,242 | A | 7/1994 | Lucky, Sr. | |
| 5,441,090 | A * | 8/1995 | Hill et al. | 144/4.1 |
| 5,562,386 | A | 10/1996 | Browning | |
| 5,607,251 | A | 3/1997 | Rafn | |
| 5,873,615 | A * | 2/1999 | McCullough | 294/106 |
| 5,918,923 | A | 7/1999 | Killion | |
| 5,975,604 | A | 11/1999 | Wolin et al. | |
| 6,024,145 | A | 2/2000 | Ackles | |
| 6,176,531 | B1 | 1/2001 | Wheeler | |
| 6,220,807 | B1 | 4/2001 | Sorokan | |
| 6,280,119 | B1 | 8/2001 | Ryan et al. | |
| 6,347,464 | B1 | 2/2002 | Klager | |
| 6,729,832 | B1 | 5/2004 | Word, III et al. | |
| 7,066,076 | B2 | 6/2006 | Roy et al. | |
| 7,357,163 | B2 | 4/2008 | Wager | |
| 7,503,606 | B2 | 3/2009 | Hall et al. | |
| 7,950,709 | B1 | 5/2011 | Cheney et al. | |
| 7,980,612 | B2 | 7/2011 | Hall et al. | |
| D645,062 | S | 9/2011 | LaValley et al. | |
| 8,146,971 | B2 | 4/2012 | LaValley et al. | |
| 8,328,071 | B2 | 12/2012 | LaValley et al. | |
| 8,444,366 | B2 | 5/2013 | Cole | |
| 8,590,769 | B2 * | 11/2013 | LaValley et al. | 294/86.41 |
| 2007/0013199 | A1 | 1/2007 | Hall et al. | |
| 2007/0110553 | A1 | 5/2007 | Neal et al. | |
| 2007/0280812 | A1 | 12/2007 | Morency et al. | |
| 2008/0029578 | A1 | 2/2008 | Steel et al. | |
| 2009/0057019 | A1 | 3/2009 | LaValley et al. | |
| 2009/0155040 | A1 | 6/2009 | Martin | |
| 2010/0308609 | A1 | 12/2010 | LaValley et al. | |
| 2013/0177373 | A1 * | 7/2013 | Sintek et al. | 294/106 |

FOREIGN PATENT DOCUMENTS

| | | | |
|---|---|---|---|
| DE | 102 06 645 | A1 | 8/2003 |
| KR | 20-0227816 | | 6/2001 |
| WO | 00/53522 | | 9/2000 |
| WO | 00/65193 | A1 | 11/2000 |
| WO | 03/082725 | | 10/2003 |
| WO | 2007/097698 | | 8/2007 |
| WO | 2008/076067 | | 6/2008 |
| WO | 2009/029879 | | 3/2009 |

OTHER PUBLICATIONS

Prentice Grapples specification sheet; printed Sep. 8, 2011 from http://prenticecranes.com/prentice-grapples.html; 6 sheets.

Prentice 2410-2414 Knuckleboom Loaders; printed Sep. 8, 2011 from http://prenticecranes.com/prentice-2410-2414-knuckleboom-loaders.html; 6 sheets.

"Manipulator KM 930," Kinshofer GmbH, available at http://www.kinshofer.com/site_eng/produkte_main/main_km930.html; printed May 13, 2010; 1 page.

"Manipulator KM 930," Kinshofer Gmbh, available at http://www.kinshofer.com/site_eng/produkte_main/Resources/KM_930_eng.pdf ; printed May 13, 2010; 1 page.

"Selling GB Wood Grapple products," GB Industries Co. Ltd, available at http://kennycho.trustpass.alibaba.com/product/107764499-11334694/Selling_GB_Wood_Grapple_products.html ; printed May 13, 2010; 3 pages.

"Selector/Demolition Grabs," McQuaid Engineering Ltd, available at http://www.alibaba.com/product/mcquaid84-215959236-0/Selector_Demolition-Grabs.html ; printed May 13, 2010; 3 pages.

"Kinshofer Manipulators—Kinshofer-KM930," available at http://www.worktmck-outfitters.com/kinshofer-manipulators-p-1281.html ; printed May 13, 2010; 4 pages.

Drawings and Photographs of a Grapple manufactured by Weldco Beales Mfg.; in Applicants possession on or about Mar. 20, 2010; 15 pages.

Pictures of a grapple mechanism printed from http://rotobec.com/web/2610_PH_Pipe_and_Pole-Handler.html and http://rotobec.com/resources/images/products/rotations/RGP-252_main.jpg on Mar. 30, 2010, but possibly posted on the Internet as early as Sep. 2009; 2 pages.

Five photographs taken in Jan. 2010 of a grapple mechanism used by Michels Corporation.

Drawings of Heavy Duty Pole Claw manufactured by EZ-Spot-UR, dated Apr. 29, 2010, found online at http://www.ezspotur.com/HDPC-01-0006_NO_SETBACK.pdf (1 page).

* cited by examiner

GRAB ARM HOUSING FOR GRAPPLE ATTACHMENT

FIELD

This disclosure relates to an attachment that is attachable to, for example, a trackhoe, backhoe, excavator or other piece of construction equipment for use in, for example, positioning pipe ends to join the pipe ends together.

BACKGROUND

Positioning two large diameter pipes, such as oilfield pipes, for tie-in is extremely time consuming and can take many hours and require many workers and millions of dollars worth of equipment which is very costly and slows down the production of the pipeline. In addition, the current process is hazardous to the workers. Any reduction in the time and cost it takes to make a tie-in connection is beneficial. In addition, improving the safety to ground workers would be beneficial.

SUMMARY

An attachment is described that is configured to attach to an arm of a piece of construction equipment, for example an excavator, a trackhoe, backhoe or the like. The attachment is configured to automate the process of aligning pipe ends during pipe tie-in. The attachment can fine adjust the positions of the pipe ends relative to one another in x, y and z-axis directions until the ends align with each other, at which point the pipe ends can be welded or otherwise secured to each other, and/or processed in other manners, while being held in position by the grapple mechanisms. The attachment can also be configured to leave room for a pipe processing tool, for example a welding apparatus, to perform a processing operation on one or more of the pipes, such as welding the pipe ends together.

The attachment is designed to grab the ends of two separate pipes that are going to be aligned end to end for connecting of the pipes through welding or other suitable connection means. The attachment is configured to pull the two pipes together in the Z-axis direction and also aligns them concentric to each other via independent movement in the X-axis and Y-axis directions.

As used throughout the specification and claims, the word pipe or the like, unless otherwise specified, is intended to encompass all types, shapes, and sizes of pipe that need to be laid and tied-in with other sections of pipe. The pipe can be made of any type of material including, but not limited to, metal or plastic. In cross-section, the pipe can be round, square, triangular, or have other cross-sectional shapes. In some embodiments, an end of one pipe can be connected to a device, other than another pipe end, that may be connected to the pipe, for example a valve, through which fluid can flow. Therefore, the term pipe is intended to encompass any structure through which fluid is intended to flow.

In addition, in some embodiment, the attachment can be used to grab, manipulate and process a single section of pipe. The attachment may also be used to grab, manipulate and process objects other than pipe, for example trees, logs, telephone poles, and the like.

In one embodiment, a grapple mechanism useable on a grapple attachment includes a lower arm housing, grab arms mounted to the lower arm housing, and an upper arm housing mounted to the lower arm housing. The upper arm housing and the lower arm housing are movable relative to one another in an x-direction and are moveable together in a y-direction perpendicular to the x-direction. In addition, the upper arm housing includes an opening through which a main beam of the grapple attachment can extend. Further, the upper and lower arm housings can be moveable together in a z-direction. Also, the upper and lower arm housings could move together in the x, y and z directions, or the upper and lower arm housings could move relative to one another in the x,y and z directions.

In another embodiment, a mechanism includes a pair of grapple mechanisms mounted on a main beam, with each grapple mechanism including opposing grab arms mounted to a grab arm housing. Each grab arm housing includes a lower arm housing to which the grab arms are mounted, and an upper arm housing. The upper arm housing and the lower arm housing are movable relative to one another in an x-direction perpendicular to the main beam and are moveable together in a y-direction perpendicular to the x-direction and to the main beam. In addition, the upper arm housing includes an opening through which the main beam extends.

In use, each grapple mechanism can grab a respective pipe section near the pipe ends using the grab arms. Once the pipe sections are being held by the grab arms, the grab arm housings are adjusted relative to the main beam which adjusts the positions of the pipe ends that are held by the grab arms. The grab arm housings are adjusted until the pipe ends align, at which point the pipe ends can be secured together.

The grab arm housing(s) can be adjustable in multiple directions generally perpendicular to the longitudinal axis of the main beam. For example, when viewing the grab arm housing in side plan view, the grab arm housing is adjustable in left and right directions and/or up and down directions relative to the main beam.

For each grapple mechanism, the grab arms can be actuated by an actuator connected to one of the grab arms and a timing link interconnecting the grab arms. Alternatively, each grab arm can be actuated by an actuator connected thereto.

In one embodiment, the geometry of the grab arms and the lower arm housing are designed to handle a range of pipe diameters, for example 24-36 inch pipe, while providing 6 points of contact with the outside of the pipe within that range at all times. However, there could be more or less points of contact if desired.

The main beam of the attachment can also be adjustable in position via rotation about a vertical axis and tilting about a horizontal axis. The grab arm housings can also be adjustable in directions parallel to the longitudinal axis of the main beam as described in US 2010/0308609 which is incorporated herein by reference in its entirety. These adjustments of the main beam and the grab arm housings, together with the adjustments of the grab arm housings relative to the main in one or more directions generally perpendicular to the longitudinal axis of the main beam, permit precise positioning of the grapple mechanisms to grab the pipe ends.

Although the preceding paragraph mentions a pair of grapple mechanisms, it is possible that more than two grapple mechanisms can be used. For example, three or more grapple mechanisms could be mounted on the main beam. Not all of the grapple mechanisms need be adjustable in the manner described depending on the intended function of the grapple mechanism.

DRAWINGS

Figure 5A:
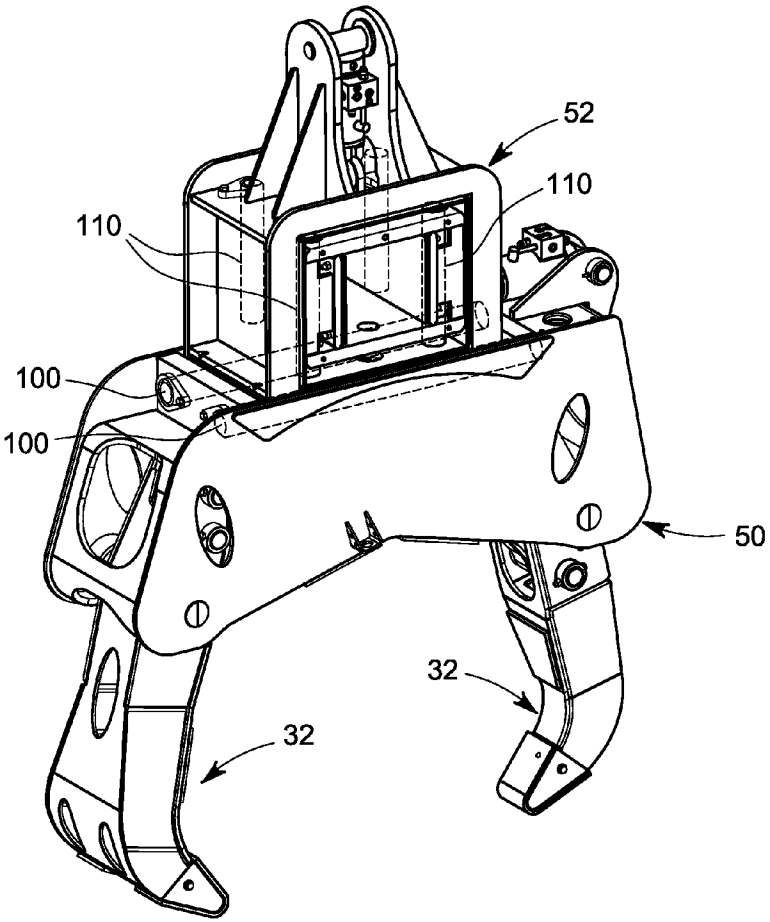

FIG. 5*a* is an isometric perspective view of another embodiment of a grapple mechanism with the grapple mechanism shown transparent to better illustrate construction and operation.

Figure 5C:
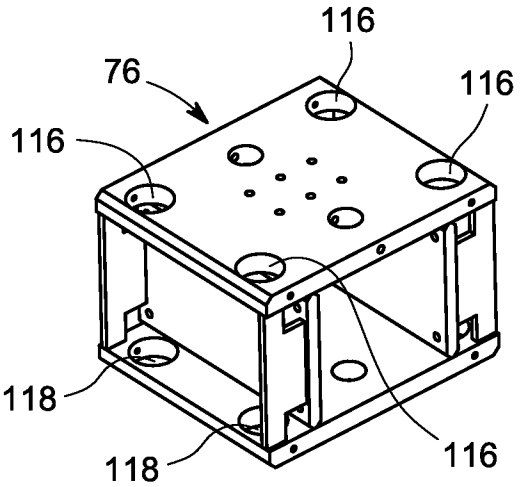
Figure 5B:
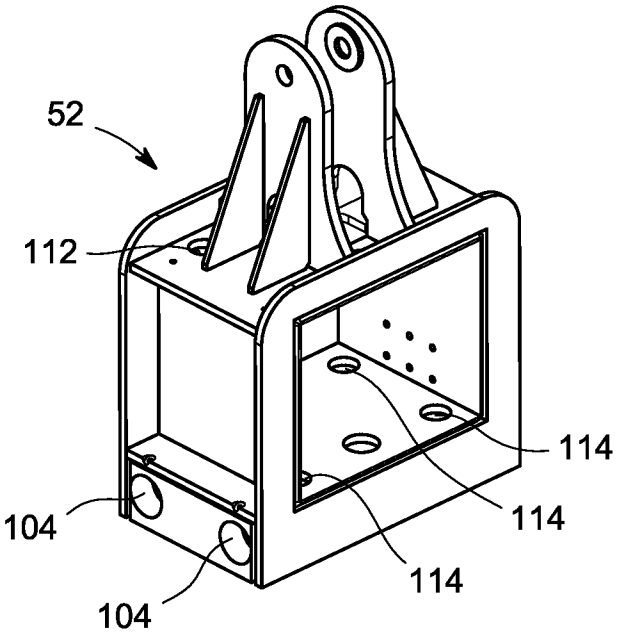

FIGS. 5*b* and 5*c* are isometric perspective views of the upper arm housing and the torque tube, respectively, of the grapple mechanism of FIG. 5*a*.

Figure 6:
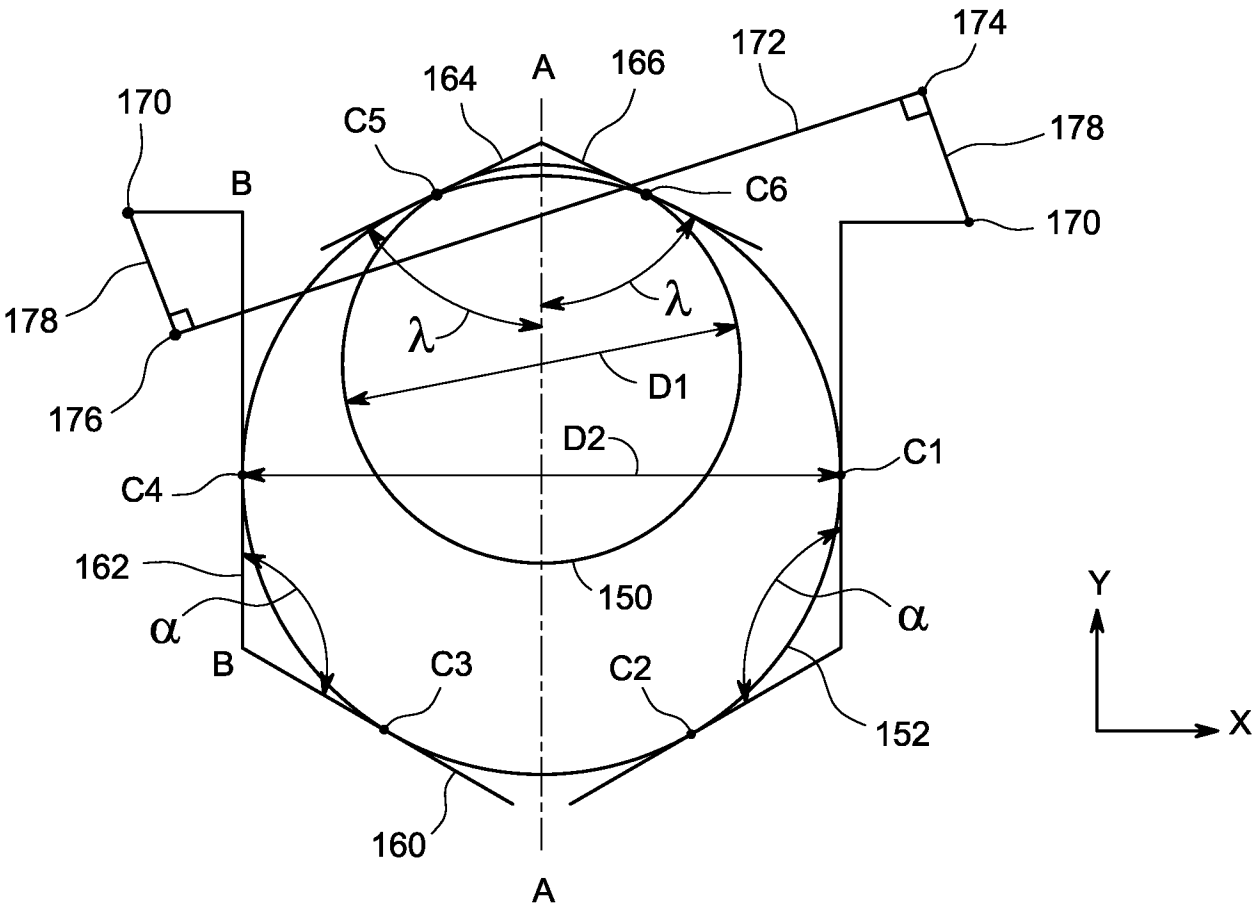

FIG. 6 is a diagram showing the geometry of the lower arm housing and the grab arms and points of contact with different diameters of pipe.

DETAILED DESCRIPTION

Figure 1:
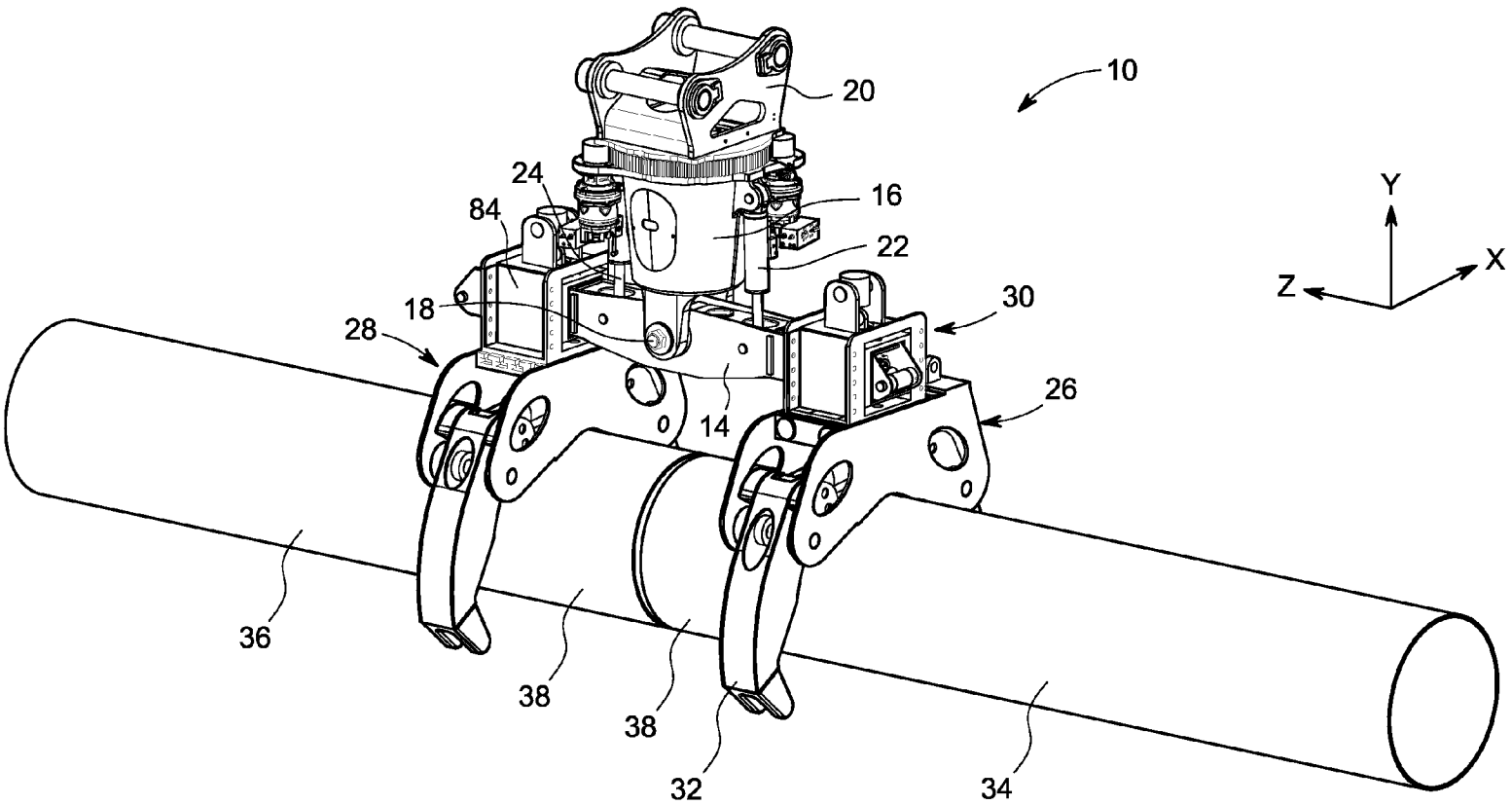
FIG. 1 is an isometric perspective view of an attachment for mounting to an arm of a piece of construction equipment.

With reference to FIG. 1, an attachment 10 is illustrated that is configured to align pipe ends during pipe tie-in. The attachment 10 is mounted to an arm of a piece of construction equipment (not illustrated). The attachment 10 includes a main beam 14 that is pivotally connected to the base of a lower head assembly 16 by a pivot 18. The lower head assembly 16 is rotatably connected to a mount bracket 20 to permit the lower head assembly 16 to rotate or swivel 360 degrees relative to the mount bracket about a vertical axis. The mount bracket 20 detachably mounts the attachment to the arm of the construction equipment. Tilt actuators 22, 24 extend between the lower head assembly 16 and the main beam 14 to selectively tilt the main beam about the pivot 18. Further information on the construction and operation of a main beam, lower head assembly, mount bracket and the tilt actuators can be found in US 2009/0057019, US 2010/0308609, and in U.S. patent application Ser. No. 13/398,995 filed on Feb. 17, 2012, which are incorporated herein by reference in their entireties.

The attachment 10 includes a pair of grapple mechanisms 26, 28 that are detachably mounted on the main beam 14. The grapple mechanisms 26, 28 are mounted on the main beam so that each grapple mechanism is individually adjustable relative to the main beam along the length of the main beam in the z-axis direction. Adjustment of each grapple mechanism 26, 28 in the z-direction is achieved by shift actuators fixed at one end to the main beam and fixed at an opposite end to the grapple mechanisms 26, 28. Further information on shifting grapple mechanisms in the z-direction on a main beam is described in US 2010/0308609 and in U.S. patent application Ser. No. 13/398,995. The detachable mounting of the grapple mechanisms 26, 28 permits removal and replacement of grapple mechanisms with replacement grapple mechanisms, which could have the same or similar configuration or have a different configuration.

As discussed in U.S. patent application Ser. No. 13/398,995, the spacing between the grapple mechanisms 26, 28 can be sufficient to leave room for a pipe processing tool, for example a welding apparatus or other pipe fastening apparatus to be applied to the pipes for physically connecting the pipe ends. In addition to or separately from welding, other pipe processing operations can be performed using the pipe processing tool mounted on the attachment. Examples of other pipe processing operations includes coating one or more of the pipe ends, painting the pipes, cutting one or more of the pipes, applying a seal to seal the pipe ends, beveling one or more of the pipe ends, or sand blasting one or more of the pipe ends. Other processing operations are possible. Depending upon the processing operation, the processing operation can be performed before or after the pipe ends are aligned with each other.

The pipe processing tool can be mounted on the attachment 10, for example on the main beam 14, or it can be separate from the attachment 10.

The grapple mechanisms 26, 28 illustrated in the drawings are similar in construction, however they could be constructed differently. Each grapple mechanism includes a grab arm housing 30 and grab arms 32 connected to the grab arm housing.

As shown in FIG. 1, each grapple mechanism 26, 28 is designed to pick up an end of a pipe 34, 36 using the grab arms 32 under the power of the construction equipment. The positions of the grab arm housings are then adjusted in the x, y and/or z-axis directions as necessary to align the pipe ends 38 during pipe tie-in. The aligned ends can then be welded or otherwise secured to each other, and/or other processing operations performed.

The z-axis direction is considered generally parallel to the ground, or parallel to the main beam, or parallel to the pipes. The x-axis direction is a forward and rearward direction generally perpendicular to the z-axis direction and perpendicular to the main beam 14. The y-axis direction is an up and down direction generally perpendicular to the z-axis direction and to the x-axis direction, and perpendicular to the main beam 14.

The attachment 10 can be used in a horizontal orientation with horizontal pipe and with the main beam 14 oriented generally parallel to the ground. The attachment 10 can also be used in a vertical orientation with vertical pipe, with the main beam 14 oriented generally perpendicular to the ground. The attachment can also be used with pipes that are oriented at angles between horizontal and vertical.

Figure 2:
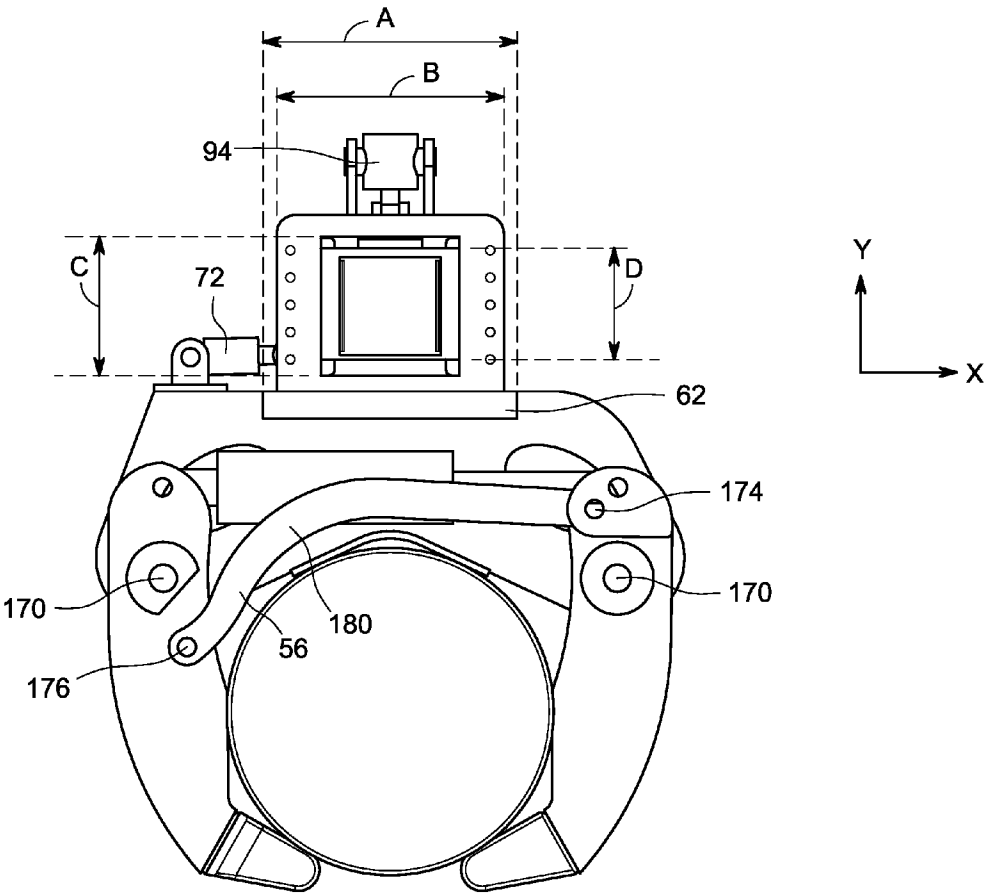
FIG. 2 is a side view of one of the grapple mechanisms with some components shown transparent to better illustrate construction and operation.
Figure 3:
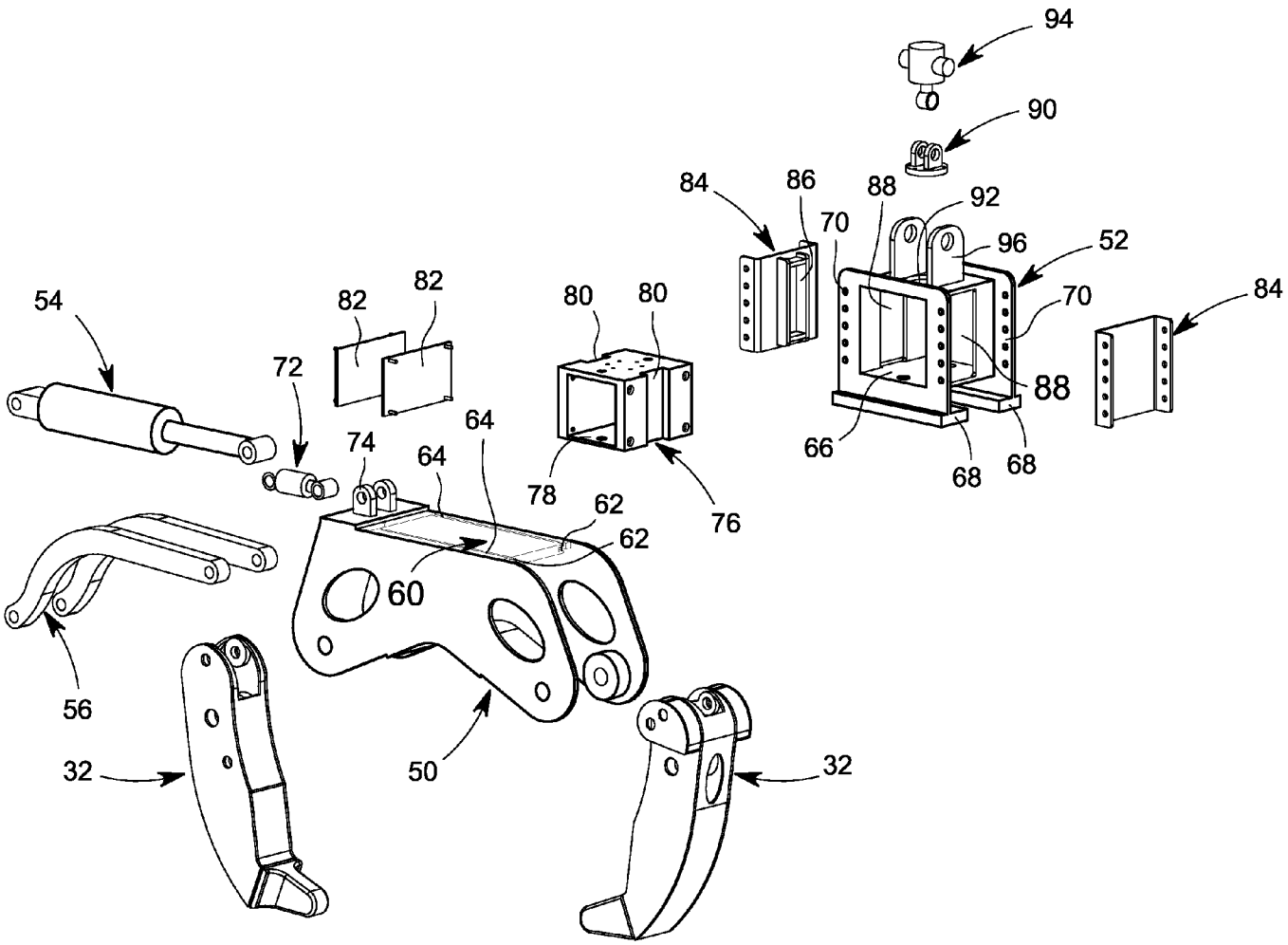
FIG. 3 is an exploded view of the components of the grapple mechanism of FIG. 2.

FIGS. 2 and 3 illustrate details of one embodiment of the grapple mechanism 26. As indicated above, the grapple mechanism 28 is similar in construction to the grapple mechanism 26 so it is not described separately. In this embodiment, the grab arm housing 30 is a two-piece housing including a lower arm housing 50 and an upper arm housing 52. The arm housings 50, 52 are connected to one another in such a manner as to permit x and y adjustments of the lower arm housing 50 so as to adjust the positions of the pipe ends 38 held by the grapple mechanisms in the x and y directions.

In one embodiment, the lower arm housing 50 can be detachably mounted from the upper arm housing 52. This would permit the lower arm housing to be removed and replaced with a different lower arm housing.

The grab arms 32 are pivotally connected to the lower arm housing 50. Two sets of grabs arms are provided which are disposed on opposite sides of the lower arm housing. The grab arms 32 can have any configuration suitable for gripping and holding pipe during use. Further information on suitable configurations of grab arms for engaging pipe is disclosed in US 2009/0057019 and US 2010/0308609.

Each grab arm 32 is rotatably mounted to the lower arm housing by a pivot. The upper end of one of the grab arms is connected to an end of an actuator 54, for example a hydraulic cylinder. The opposite end of the actuator 54 is fixed to the lower arm housing 50. One or more timing links 56 extend between the grab arms so that actuation of the one grab arm by the actuator 54 results in actuation of the other grab arm via the timing link(s) 56. However, the timing link(s) 56 is not necessary if one of the grab arms is fixed, or if separate actuators are used for each grab arm.

The grab arms 32 are actuatable between a closed position gripping the pipe (shown in FIG. 2) and an open position (shown in FIG. 1) to permit the grapple mechanisms to be disposed over the respective pipes 34, 36. Extension of the actuator 54 pivots the grab arm 32 inwardly toward the closed position. At the same time, the timing link(s) 56 connected to the other grab arm actuates the other grab arm inwardly toward the closed position. Conversely, retraction of the actuator pivots the grab arms outwardly toward the open position.

In an alternative embodiment, an actuator can be provided to actuate each of the grab arms. Also, one of the grab arms on one or both of the grapple mechanisms could be fixed while only the other grab arm is actuated.

With reference to FIG. 3, the top side of the lower arm housing 50 has a block 60 formed with opposing slide channels 62. Vertical channels 64 extend upwardly from the slide channels 62 and through the upper surface of the block 60. The slide channels 62 are illustrated as extending the length of the slide block over a distance A (see FIG. 2).

The upper arm housing 52 is designed to slidably engage with the slide channels 62 and the channels 64 to permit the lower arm housing 50 to slide back and forth relative to the upper arm housing in the x direction. In particular, with reference to FIG. 3, the upper arm housing 52 is illustrated as being a rectangular structure having a rectangular passageway 66 through which the main beam 14 extends. The base of the upper arm housing 52 is provided with opposite rectangular slide blocks 68 that are connected to side plates 70 that form opposite walls of the arm housing 52. With reference to FIG. 2, the side plates 70 have a length B in the x-direction that is less than the length A.

In use, the slide blocks 68 are disposed within the slide channels 62, and the plates 70 extend upwardly through the channels 64. This construction permits the lower arm housing 50 to slide in the x-direction relative to the upper arm housing 52. Movement of the lower arm housing 50 is achieved using an actuator 72, for example a hydraulic cylinder, having one end thereof fixed to a mounting structure 74 on the lower arm housing 50 and a second end suitably fixed directly or indirectly to the upper arm housing 52.

Returning to FIG. 3, a torque tube 76 is disposed around the main beam 14 and extends through the upper arm housing. The torque tube 76 closely fits around the main beam and is designed to permit movements of the upper arm housing 52, together with the lower arm housing 50, relative to the main beam in the y-direction.

The torque tube 76 is a rectangular tubular structure having a central passageway 78 through which the main beam extends. The torque tube 76 also extends through the upper arm housing generally from one plate 70 to the other plate 70 as shown in FIGS. 1 and 2. Opposite sides of the torque tube 76 are formed with vertical slide channels 80 that are illustrated as extending from the bottom to the top of the torque tube.

In use, the torque tube 76 is designed to slide with the grapple mechanism in the z-direction. To facilitate the sliding movement in the z-direction, slide pads 82 are fixed on the inside of the torque tube between the sidewalls of the torque tube and the outer side walls of the main beam. The slide pads 82 slide with the torque tube in the z-direction and help reduce friction and wear on the main beam and on the inside of the torque tube.

To lock the torque tube 76 to the upper arm housing 52 in the z-direction, torque tube lock plates 84 are provided. Each torque tube lock plate 84 is configured to fit and be secured between the ends of the plates 70 as seen in FIG. 1. The inside surface of each plate 84 is provided with a rectangular shaped ridge 86 that fits through an opening 88 formed in the upper arm housing 52 and is disposed within the respective vertical slide channel 80. The interaction between the ridges 86 and the slide channels 80 forces the torque tube to slide in the z-direction with the grapple mechanism, while permitting the upper arm housing 52 to slide vertically relative to the torque tube 76 in the y-direction.

With reference to FIG. 2, the vertical dimension C of the passageway 66 of the upper arm housing 52 is greater than the vertical height D of the torque tube 76. This allows the upper arm housing 52 to slide vertically relative to the torque tube 76 in the y-direction. The horizontal dimension of the passageway 66 is only slightly greater than or approximately equal to the horizontal dimension of the torque tube 76 to prevent relative movements between the upper arm housing and the torque tube in the x-direction.

To achieve y-direction movements, a clevis 90 is fixed to the top of the torque tube 76 and extends upwardly through an opening 92 in the upper arm housing. An actuator 94, for example a hydraulic cylinder, has one end thereof fixed to a mounting structure 96 on the upper arm housing 52 and a second end suitably fixed to the clevis 90.

With reference to FIGS. 2 and 3, x-direction movements of the individual grapple mechanisms 26, 28, and thus of the pipes 34, 36, are achieved as follows. To move to the right (i.e. front and back in the x direction) in FIG. 2, the actuator 72 is retracted to apply a force pulling the upper arm housing 52 toward the left in FIG. 2. Since the torque tube 76 fits closely around the main beam 14, and the horizontal dimension of the passageway 66 is only slightly greater than or approximately equal to the horizontal dimension of the torque tube 76, the upper arm housing 52 cannot move right or left in the x-direction. Therefore, retraction of the actuator 72 will force the lower arm housing 50 to move in the x-direction to the right in FIG. 2. Similarly, extension of the actuator 72 will push against the upper arm housing 52, with reaction forces then forcing the lower arm housing to move the left in FIG. 2.

Y-direction movements (i.e. up and down) of the individual grapple mechanisms 26, 28, and thus of the pipes 34, 36, are achieved as follows. To move vertically upward in the y-direction, the actuator 94 is extended. This pushes downward on the top of the torque tube 76 which closely fits around the main beam. The reaction forces will force the upper arm housing 52 upwardly relative to the torque tube. Since the upper arm housing is fixed to the lower arm housing, the lower arm housing will also move upward. To move vertically downward in the y-direction, the actuator 94 is retracted. The upper and lower arm housings will then move downward.

The upper and lower arm housings are described as being moveable relative to one another in the x-direction, moveable together in the y-direction, and moveable together in the z-direction. However, other variations are possible. For example, the upper and lower arm housings could move together in the x, y and z directions. In another example, the upper and lower arm housings could move relative to one another in the x,y and z directions.

Other mounting techniques to permit movements of the arm housing 50, 52 in the x and y directions are possible. For example, FIGS. 4 and 5*a-c* illustrate two possible alternative mounting techniques. In FIGS. 4 and 5*a-c*, elements that are the same or similar as elements in FIGS. 2-3 are referenced using the same reference numerals.

Figure 4:
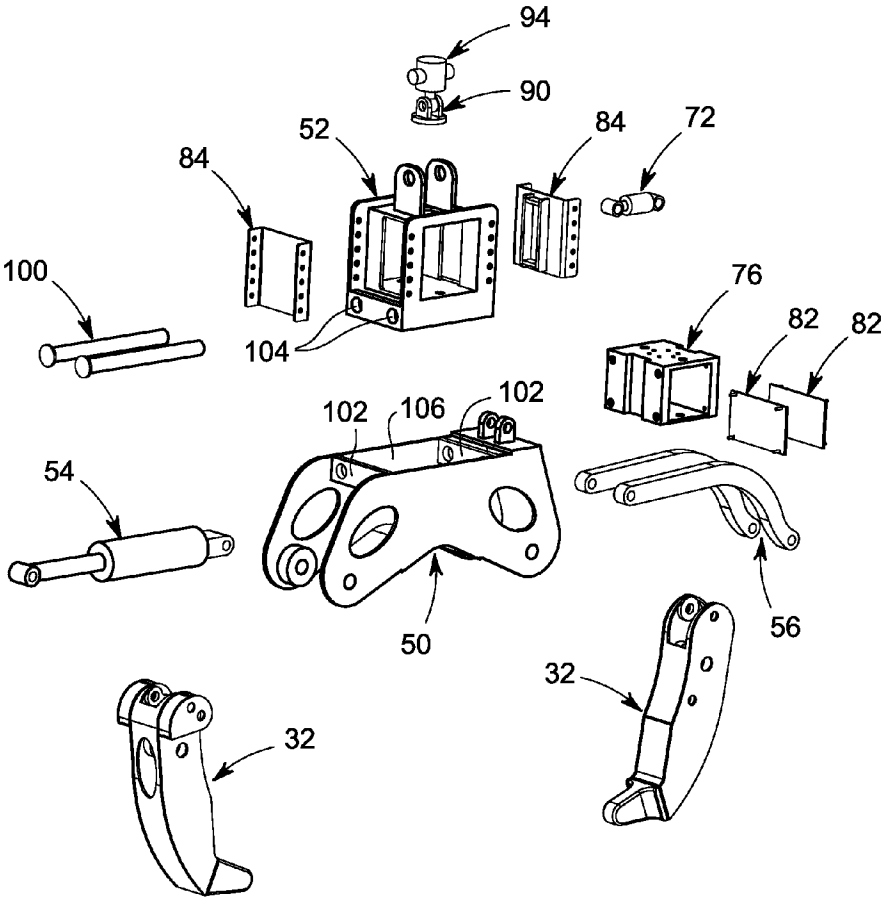
FIG. 4 is an exploded view of the components of another embodiment of a grapple mechanism.

The grapple mechanism illustrated in FIG. 4 is shown mounted on the attachment 10 in FIG. 1. In the embodiment of the grapple mechanism illustrated in FIG. 4, instead of the slide channels 62 and the slide blocks 68 used in FIGS. 2-3, the lower arm housing 50 slides relative to the upper housing 52 in the x-direction via one or more pins 100. The pin(s)

extend between opposite brackets 102 on the lower arm housing 50, and extend through openings 104 formed in the base of the upper arm housing 52. Only the openings 104 at one side of the upper arm housing are visible in FIG. 4. Similar openings would be formed in the base at the other side of the upper arm housing. The base of the upper arm housing fits into an opening 106 formed in the lower arm housing. The length of the base of the upper arm housing in the x-direction is less than the length of the opening 106 in the x-direction, to permit relative movements in the x-direction between the upper and lower arm housings.

In the embodiment of the grapple mechanism illustrated in FIGS. 5*a-c*, the lower arm housing 50 is similar to the lower arm housing in FIG. 4 in that relative sliding movement between the upper arm housing 52 and the lower arm housing 50 in the x-direction is permitted via the pin(s) 100. In addition, vertical sliding movements between the upper arm housing 52 and the torque tube 76 are also facilitated by vertical pins 110. In the illustrated embodiment, four vertical pins 110 are provided, although a smaller or larger number of pins could be used.

In this embodiment, the upper arm housing 52 is provided with four pin holes 112 in the top thereof and four corresponding pins holes 114 in the bottom. Likewise, the torque tube 76 is formed with pin holes 116 in the top thereof and pin holes 118 in the bottom thereof that are aligned with the pins holes 112, 114 when the torque tube is disposed within the upper arm housing as described above in FIGS. 2-3. The pins 110 guide the relative vertical movements in the y-direction between the upper arm housing and the torque tube, as well as force the torque tube to move with the upper arm housing during movements in the z-direction.

In the embodiments illustrated and described herein, the grab arm housings are adjustable relative to the main beam in y-axis directions and x-axis directions. However, the grab arm housings need not be adjustable in all of the illustrated directions. Instead, it is contemplated herein that the grab arm housings could be adjustable in just an x-direction or in a y-direction.

In addition, the grab arm housings of both of the grapple mechanisms 26, 28 need not be adjustable in x, y and/or z-directions on the main beam. Instead, one grapple mechanism could hold a pipe and be fixed on the main beam, while x, y and z-direction adjustments are accomplished using the other grapple mechanisms holding the other pipe.

In addition, although the main beam and the passageways 66, 78 are illustrated and/or described as being rectangular, shapes other than rectangular are possible such as round or triangular. In addition, the main beam and the passageways 66, 78 need not have the same shape. For example, the main beam could be round in cross-sectional view and the one or more of the passageways 66, 78 could be rectangular.

In addition, the passageways 66, 78 need not have the same shape.

The grapple mechanisms 26, 28 can be designed for use with any size, i.e. diameter, and shape of pipe. For example, it is believed that the grapple mechanisms 26, 28 would be suitable for round pipes between about 26 inches to about 38 inches in diameter. However, the grapple mechanisms can be used with pipe having other diameters.

In use, after the pipes 34, 36 have been cut and the ends 38 roughly positioned near each other, the attachment 10 is brought by the arm of the construction equipment into position near the ends 38 of the two pipes 34, 36. If necessary, the main beam 14 is tilted and/or rotated by the lower head assembly 16 and the tilt actuators 22, 24 to properly align the attachment with the pipe ends. Preferably, the pipe ends 38 are positioned approximately midway between the two grapple mechanisms as shown in FIG. 1.

The attachment is then lowered into position so that the grapple mechanism 26 surrounds the pipe 34 and the grapple mechanism 28 surrounds the pipe 36 as shown in FIGS. 1 and 2. The grab arms are then actuated to bring the grab arms to the closed position shown in FIG. 2 so as to grab the pipes 34, 36.

If necessary, the positions of one or both of the grapple mechanisms 26, 28 along the main beam are adjusted in the z-axis direction to bring the pipe ends closer to each other. In addition, the operator actuates the various actuators 72, 94 as needed to fine adjust the positions of the grab arm housings in the x and y-directions. Because the grab arms are gripping the pipes, and the grab arms are fixed to the grab arm housings, the pipe ends move with the grab arm housings. Thus, the grapple mechanisms 26, 28 can be used to fine adjust the positions of the pipe ends to achieve alignment.

With reference to FIG. 6, the geometry of the grab arms 32 and the lower arm housing 50 can be designed to handle a range of pipe diameters D1 to D2, for example 24-36 inch pipe, while providing 6 points of contact at all times with the outside of the pipe for all pipe diameters within that range. FIG. 6 shows one pipe 150 having a diameter of D1 and a second pipe 152 having a larger diameter D2. The grab arms 32 are shown schematically and have four points of contact c1 to c4 with the second pipe 152. Likewise, the lower arm housing 50 is shown schematically and has two points of contact c5 to c6 with the second pipe 152. These six points of contact c1 to c6 help the grapple mechanisms 26, 28 securely hold the pipe 152. A similar six points of contact occur in the case of the pipe 150 having the diameter D1, and with pipe having diameters between D1 and D2. The points of contact c1 to c6 can either be directly with the inner surfaces of the grab arms and lower arm housing, or with wear pads that are connected to the inner surfaces.

To achieve these six points of contact, the geometry of certain components of the grapple mechanisms 26, 28 are carefully selected. For example, the angle $\alpha$ between a first inner surface 160 and a second inner surface 162 of each grab arm 32 is selected to be within a predetermined range. Likewise, the angle $\lambda$ between first and second inner surfaces 164, 166 of the lower arm housing and a vertical axis A-A is selected to be within a predetermined range. In addition, a straight line distance D1 between a vertical axis B-B tangent to the pipe 152 and the pivot point 170 of each grab arm 32 is within a predetermined range. In the case where wear pads are used on the inner surfaces, the angles and distances are determined accounting for the presence of the wear pads. Moreover, a straight line 172 connecting the pivot points 174, 176 of the timing link(s) 56 to the grab arms is made generally perpendicular to straight lines 178 connecting the pivot points 170 to the pivot points 174, 176.

The selected geometry is also impacted by the design of the timing link(s) 56. With reference to FIG. 2, the timing link(s) has a first end pivotally connected to the right grab arm at pivot point 174 and a second end pivotally connected to the left grab arm at pivot point 176. Between the two ends, to avoid interference with the pipe, the timing link(s) 56 has a curved intermediate section 180 whereby the pivot point 176 is located vertically lower than the pivot point 174.

To provide six points of contact on pipes ranging in diameter between about 24 to 36 inches with the timing link(s) 56 configuration shown in FIG. 2, the following exemplary specific geometry has been found to work satisfactory:

$\alpha$ can range from about 120 degrees to about 150 degrees, and can be about 125 degrees;

λ can range from about 60 degrees to about 75 degrees, and can be 75 degrees;

D1 can range from about 4 inches to about 9 inches, and can be about 7 inches; and line 172 is generally perpendicular to the lines 178.

Of course, other dimensions for α, λ and D1 can be used. In addition, there could be more or less than six points of contact c1 to c6 if desired.

The embodiment illustrated in FIG. 1 shows the use of one attachment, having two grapple mechanisms, mounted on the main beam 14. It is contemplated that separate attachments could be utilized, each having one or two grapple mechanisms, with each attachment being connected to arms of separate construction equipment, with one attachment grabbing and adjusting one pipe end and the other attachment grabbing and adjusting the other pipe end. Also, two grapple mechanisms could be used to grab each pipe.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A grapple mechanism useable on a grapple attachment, comprising:

a lower arm housing;

grab arms mounted to the lower arm housing, at least one of the grab arms is movable relative to the lower arm housing, and the grab arms have an open position and a closed position;

an upper arm housing separate from and detachably mounted to the lower arm housing, the upper arm housing includes an opening through which a main beam of the grapple attachment can extend, the opening having an axis in a z-direction, and the upper arm housing and the lower arm housing are movable relative to one another in an x-direction that is perpendicular to the axis and are moveable together in a y-direction perpendicular to the x-direction and to the axis.

2. The grapple mechanism of claim 1, comprising at least two of the grab arms pivotally attached to the lower arm housing, the two grab arms face one another, and a timing link extending between the two grab arms so that movement of one of the two grab arms causes movement of the other grab arm via the timing link.

3. The grapple mechanism of claim 1, further comprising a torque tube disposed within the upper arm housing, the torque tube including a passageway through which the main beam of the grapple attachment can extend.

4. The grapple mechanism of claim 3, wherein the torque tube, the upper arm housing and the lower arm housing are movable together in the z-direction, and the upper arm housing and the lower arm housing are movable relative to the torque tube in the y-direction.

5. A mechanism comprising:

a main beam having an axis that extends in a z-direction;

a pair of grapple mechanisms detachably mounted on the main beam, each grapple mechanism includes:

a lower arm housing;

grab arms mounted to the lower arm housing, at least one of the grab arms is movable relative to the lower arm housing, and the grab arms have an open position and a closed position;

an upper arm housing separate from and detachably mounted to the lower arm housing, the upper arm housing includes an opening through which the main beam of the grapple attachment extends, the opening having an axis in the z-direction, and the upper arm housing and the lower arm housing are movable relative to one another in an x-direction that is perpendicular to the z-direction and are moveable together in a y-direction perpendicular to the x-direction and to the z-direction.

6. The mechanism of claim 5, wherein there are at least two of the grab arms pivotally attached to the lower arm housing, the two grab arms face one another, and a timing link extending between the two grab arms so that movement of one of the two grab arms causes movement of the other grab arm via the timing link.

7. The mechanism of claim 5, further comprising a torque tube disposed within the upper arm housing, the torque tube including a passageway through which the main beam of the grapple attachment extends.

8. The mechanism of claim 7, wherein the torque tube, the upper arm housing and the lower arm housing are movable together in the z-direction, and the upper arm housing and the lower arm housing are movable relative to the torque tube in the y-direction.

9. An attachment comprising:

a mount bracket;

a lower head assembly rotatably connected to the mount bracket;

a main beam pivotally connected to the lower head assembly, the main beam having an axis that extends in a z-direction;

a tilt actuator having one end fixed to the lower head assembly and a second end fixed to the main beam;

a pair of grapple mechanisms detachably mounted on the main beam, each grapple mechanism includes:

a lower arm housing;

grab arms mounted to the lower arm housing, at least one of the grab arms is movable relative to the lower arm housing, and the grab arms have an open position and a closed position;

an upper arm housing separate from and detachably mounted to the lower arm housing, the upper arm housing includes an opening through which the main beam of the grapple attachment extends, the opening having an axis in the z-direction, and the upper arm housing and the lower arm housing are movable relative to one another in an x-direction that is perpendicular to the z-direction and are moveable together in a y-direction perpendicular to the x-direction and to the z-direction.

10. The attachment of claim 9, wherein there are at least two of the grab arms pivotally attached to the lower arm housing, the two grab arms face one another, and a timing link extending between the two grab arms so that movement of one of the two grab arms causes movement of the other grab arm via the timing link.

11. An attachment comprising:

a mount bracket;

a lower head assembly rotatably connected to the mount bracket;

a main beam pivotally connected to the lower head assembly, the main beam having an axis that extends in a z-direction;

a tilt actuator having one end fixed to the lower head assembly and a second end fixed to the main beam;

a pair of grapple mechanisms detachably mounted on the main beam, each grapple mechanism includes:

a lower arm housing;

grab arms mounted to the lower arm housing, at least one of the grab arms is movable relative to the lower arm housing, and the grab arms have an open position and a closed position;

an upper arm housing mounted to the lower arm housing, the upper arm housing includes an opening through which the main beam of the grapple attachment extends, the opening having an axis in the z-direction, and the upper arm housing and the lower arm housing are movable relative to one another in an x-direction that is perpendicular to the z-direction and are moveable together in a y-direction perpendicular to the x-direction and to the z-direction; and a torque tube disposed within the upper arm housing, the torque tube including a passageway through which the main beam of the attachment extends.

12. The attachment of claim 11, wherein the torque tube, the upper arm housing and the lower arm housing are movable together in the z-direction, and the upper arm housing and the lower arm housing are movable relative to the torque tube in the y-direction.

* * * * *